US007926808B1

(12) United States Patent
Gullotta

(10) Patent No.: US 7,926,808 B1
(45) Date of Patent: Apr. 19, 2011

(54) MODIFIED ROULETTE GAME

(76) Inventor: Richard Gullotta, Forked River, NJ (US)

( * ) Notice: Subject to any disclaimer, the term of this patent is extended or adjusted under 35 U.S.C. 154(b) by 1175 days.

(21) Appl. No.: 11/063,426

(22) Filed: Feb. 22, 2005

(51) Int. Cl.
*A63F 5/00* (2006.01)

(52) U.S. Cl. ..... 273/142 R; 273/142 F

(58) Field of Classification Search ..... 273/142 R, 273/142 E, 142 F, 142 G, 142 H, 142 HA, 273/143 R; 463/17
See application file for complete search history.

(56) References Cited

U.S. PATENT DOCUMENTS

| | | | | | |
|---|---|---|---|---|---|
| 1,670,692 | A | * | 5/1928 | Rosar | 273/142 F |
| D83,725 | S | | 3/1931 | Flaherty | |
| D90,177 | S | | 6/1933 | Brady | |
| 2,077,124 | A | * | 4/1937 | Miller et al. | 273/142 HA |
| D167,011 | S | | 6/1952 | Waer | |
| 2,866,601 | A | * | 12/1958 | Naber | 235/114 |
| 3,608,901 | A | * | 9/1971 | Royle | 273/245 |
| 3,690,668 | A | * | 9/1972 | Weeks et al. | 273/138.1 |
| 3,853,324 | A | * | 12/1974 | Reiner et al. | 273/142 E |
| 5,042,810 | A | | 8/1991 | Williams | |
| 5,934,999 | A | * | 8/1999 | Valdez | 463/17 |
| 6,164,647 | A | * | 12/2000 | Chee | 273/142 R |
| 6,217,022 | B1 | * | 4/2001 | Astaneha | 273/138.1 |
| 6,302,395 | B1 | | 10/2001 | Astaneha | |
| 6,352,260 | B1 | * | 3/2002 | Santiago | 273/274 |
| 6,406,022 | B1 | * | 6/2002 | Nadibaidze | 273/274 |
| 6,520,854 | B1 | | 2/2003 | McNally | |
| 6,663,106 | B1 | | 12/2003 | Cosmi | |

* cited by examiner

*Primary Examiner* — Gene Kim
*Assistant Examiner* — Alyssa M Hylinski
(74) *Attorney, Agent, or Firm* — Greenberg Traurig

(57) ABSTRACT

A modified roulette game is disclosed. A conventional roulette wheel is segmented into multiple sections. In one version the roulette wheel is segmented into six sections which are uniquely color-coded. A roulette game layout is correspondingly color-coded such that individual number wager areas and section wager areas match the color-coding from the wheel sections. With six sections, winning section wagers are paid at 5 to 1. More or less than six wheel sections are conceivable. The modified roulette game disclosed is ideal for single zero and double zero roulette wheels. Indeed, the concept eliminates player apprehension associated with playing roulette facilitated by the two types of roulette wheels.

13 Claims, 3 Drawing Sheets

MODIFIED ROULETTE GAME

FIELD OF THE INVENTION

The embodiments of the present invention relate to a modified roulette game.

BACKGROUND

As gaming continues to enjoy widespread acceptance, casinos are in constant need of new games of chance to retain experienced patrons and to attract new patrons. Even though electronic gaming devices (e.g., slot machines) now generate more revenue than table games, many players continue to prefer the skill requirements and personal interaction of live gaming. Therefore, live gaming is an integral part of the success of any casino.

Nonetheless, as floor space for table games continues to be encroached by electronic gaming machines, casinos must be very selective with the new live games they place on their casino floor. Accordingly, because players prefer games with familiar concepts, casinos are more apt to consider new games which are based, at least in part, on existing popular games (e.g., Roulette). Importantly, the modification of an existing game should not require a new table or any modification to the underlying game.

More particularly, roulette is a game that has been around for decades and continues to command large crowds. Although roulette odds dramatically favor the house, players enjoy roulette because of its simplicity and the connection with numbers. In other words, everyone has a lucky number. One inherent problem with roulette is the distinction between roulette wheels having a single zero (i.e., "0") and those having two zeros (i.e., "0" and "00"). The problem is that the numbers 1-36 are dispersed differently around each of the wheels. Thus, a player accustomed to wagering on numbers forming a wheel segment on a single zero wheel is uncomfortable at a double zero wheel because his or her segment numbers are dispersed differently on the double zero roulette wheel.

Consequently, there continues to be a need for new roulette game based on the well-known game of roulette and which provides players with a simple means for playing a single zero or double zero roulette wheel.

SUMMARY

Accordingly, a first embodiment of the present invention comprises a modified roulette game comprising a segmented roulette wheel and corresponding gaming table layout. In the first embodiment, the roulette wheel is segmented into six sections comprising six numbers each. The six sections are uniquely colored to provide easy identification to players. The roulette table layout is modified to include six wager areas color-coded to correspond to the segmented areas. One suitable payout for a six section wager is 5 to 1. The embodiments of the present invention are suitable for a single zero or double zero roulette wheel. In fact, as described in detail below, the embodiments of the present invention eliminate the inherent problems which occur when switching from a single zero wheel to a double zero wheel and vice versa.

Other variations comprise segmenting the wheel into more or less than six sections and modifying the payouts accordingly. Other variations, embodiments and features of the present invention will become evident from the following detailed description, drawings and claims.

DETAILED DESCRIPTION

Figure 1A:
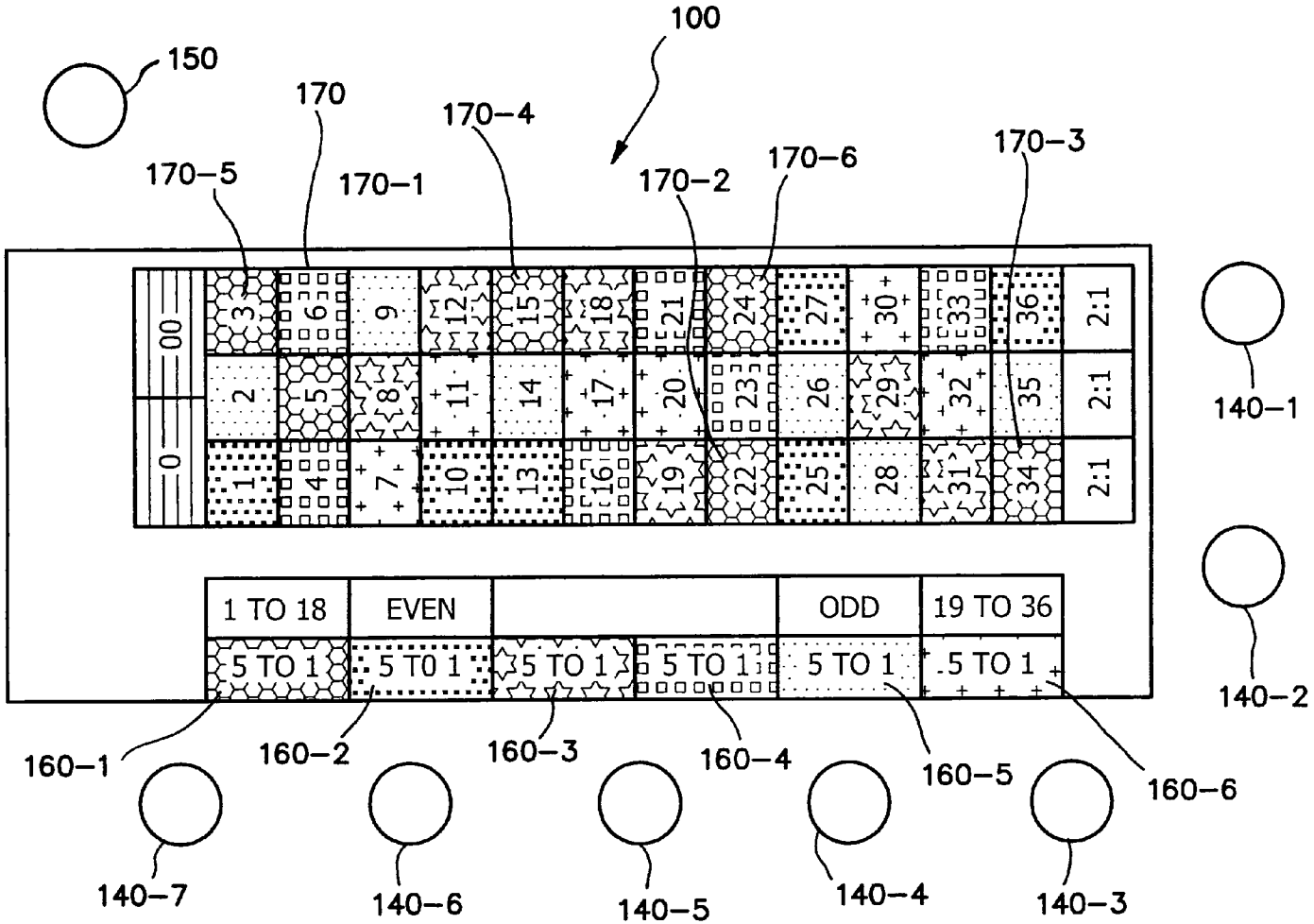
FIG. 1A shows a modified roulette game layout for a double zero roulette wheel of a first embodiment of the present invention.
Figure 1B:
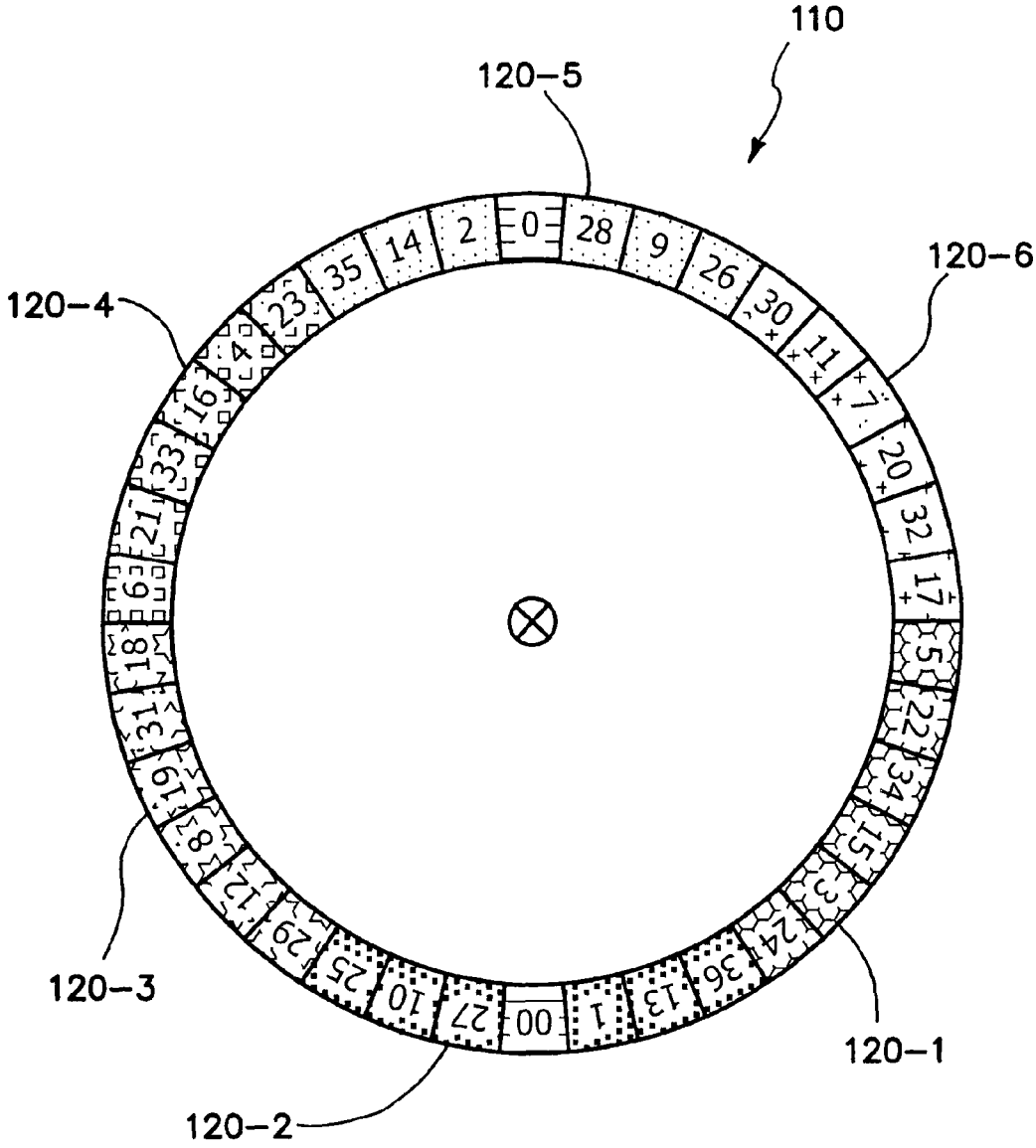
FIG. 1B shows a modified double zero roulette wheel of the first embodiment of the present invention.

Reference is now made to the figures wherein like parts are referred to by like numerals throughout. FIGS. 1A and 1B show a roulette game layout and roulette game wheel generally referred to by reference numerals 100 and 110, respectively. The roulette wheel 110 is segmented into six sections 120-1 through 120-7 comprising six roulette numbers each. In a first embodiment, each of the six sections 120-1 through 120-6 are uniquely colored for easy identification. The layout 100 accommodates multiple player positions 140-1 through 140-7 and a dealer position 150. The roulette wheel 110 shown in FIG. 1B includes a "0" and a "00" space. As described below, the embodiments of the present invention may be used with a single "0" roulette wheel as well.

The layout 100 is modified from a conventional roulette layout by adding six wager areas 160-1 through 160-6 corresponding to the segmented sections 120-1 through 120-7. The section wager areas 160-1 through 160-6 each provide a payout of 5 to 1 and, in the first embodiment, are color-coded to match the colors of the sections 120-1 through 120-6 on the wheel 110. In the first embodiment, the individual number wager areas 170 are also color-coded to identify which section 160-1 through 160-6 contains each of the thirty-six roulette numbers.

Table 1 below represents the sectional breakdown of the roulette wheel 110 in FIG. 1B along with a color scheme for each section 120-1 through 120-6.

| Section | Roulette Numbers | Color |
|---|---|---|
| 1 | 5, 22, 34, 15,3, 24 | Yellow |
| 2 | 36, 13, 1, 27, 10, 25 | Red |
| 3 | 29, 12, 8, 19, 31, 18 | Blue |
| 4 | 6, 21, 33, 16,4, 23 | Olive Green |
| 5 | 35, 14, 2, 28,9, 26 | Black |
| 6 | 30, 11, 7, 20, 32, 17 | Pink |

Although the "0" and "00" are within sections 2 and 5, respectively, they do not make up part of the section for wagering purposes. Consequently, in a conventional manner the "0" and "00" spaces remain colored green such that a ball landing in "0" or "00" does not result in a winning section wager.

With the color scheme shown in FIG. 1B, the six section wager areas 160-1 through 160-6 are correspondingly color-coded. In other words, a section 1 wager area is yellow on the layout and so on. Also, each of the number wager areas 170 are correspondingly color-coded as well. For example, the number wager areas 170-1 through 170-6 corresponding to section 1 numbers are each colored yellow on the layout 100 and so on. The layout 100 is also modified to remove the conventional black/red and $1^{st}$ twelve, $2^{nd}$ twelve and $3^{rd}$ twelve wager areas.

Importantly, the underlying game of roulette is unaffected by the segmented roulette wheel 110 and the corresponding wagers. Indeed, the game now includes new and unique wagers for players. Moreover, roulette players have often placed wagers on multiple numbers forming a particular segment or section of the roulette wheel. The color-coded numbers on the layout of the embodiments of the present invention make betting sectional numbers a simple task. Players may also still place single wagers on all of the numbers forming each section. The single numbers are color-coded on the layout to facilitate ease of wagering on single numbers in the segmented sections 120-1 through 120-6.

While FIG. 1 shows six color-coded wheel sections 120-1 through 120-6, more or less sections are conceivable. For example, nine sections of four numbers each with a 8 to 1 payout may be implemented. While a live roulette game has been discussed throughout this description, the game may be implemented on an electronic gaming device, such a video gaming machine, and/or a computer network, like the Internet.

Another important aspect of the embodiments of the present invention is that the color-coded wheel sections are ideal for a single zero roulette wheel as well. It is well-known that American roulette players prefer a double zero roulette wheel while Europeans prefer a single zero roulette wheel. Americans prefer the double zero wheel even though the house edge is greater than the single zero roulette wheel. One primary reason that players gravitate to, and prefer, a specific roulette wheel is based on the position of the thirty six non-zero numbers around the roulette wheel. The numbers around a single zero roulette are dispersed differently than those around a double zero roulette wheel. Therefore, over time players learn the position of the numbers and tend to bet numbers forming a wheel section. However, when a single zero roulette wheel player moves to a double zero roulette wheel, he or she does not know the position of the numbers. This is equally true when a double zero roulette wheel player moves to a single zero roulette wheel. The embodiments of the present invention overcome player preferences resulting in roulette players being able to comfortably move between double zero roulette wheels and single zero roulette wheels. In other words, the apprehension of not knowing the position of the numbers is eliminated by the color-coding of the wheel and layout.

Figure 2:
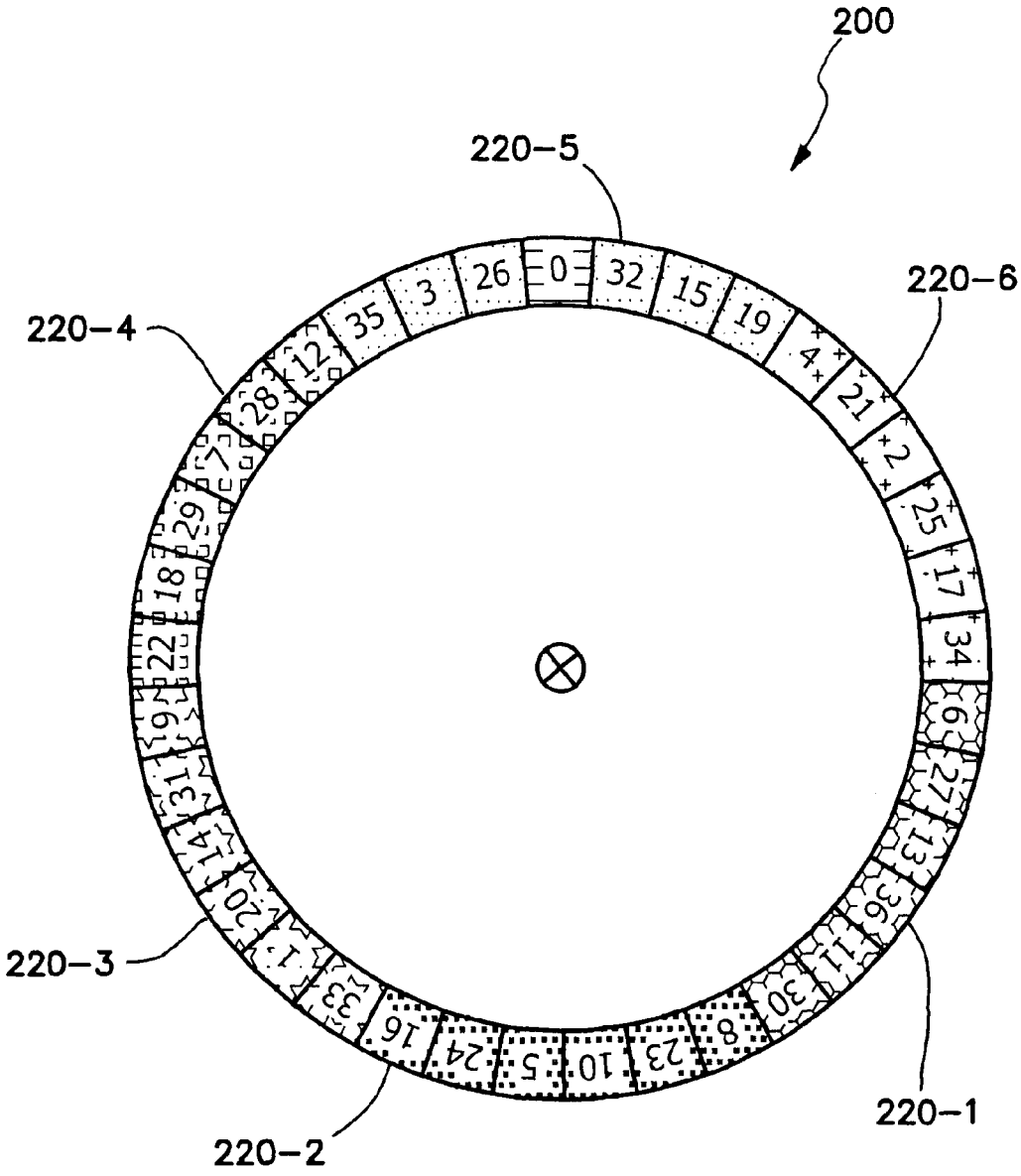
FIG. 2 shows a modified single zero roulette wheel of the first embodiment of the present invention.

FIG. 2 shows a single zero roulette wheel 200. Comparing FIG. 1B to FIG. 2 it becomes apparent that the numbers 1-36 are in different positions around the wheels. However, the color-coding remains the same. That is, the six black numbers comprise three numbers on each side of the single zero. Like the double zero roulette wheel 110, in a clockwise direction the six colors are black, pink, yellow, red, blue and olive green. Although the numbers are different, the color-coding remains the same. This is also evident on the single zero layout (not shown). In this fashion, the wheel sections 220-1 through 220-6 and the layout immediately educate the player regarding the numbers forming each color-coded section 220-1 through 220-6.

Although the invention has been described in detail with reference to several embodiments, additional variations and modifications exist within the scope and spirit of the invention as described and defined in the following claims.

I claim:

1. A method of playing a roulette game comprising:

segmenting a single roulette wheel into six sections wherein each section includes six, unique adjacent numbers, excluding zero and/or double zero which belong to none of the six sections;

means for permanently and uniquely identifying each of the multiple sections;

accepting one or more wagers including wagers on each of said multiple sections; and conducting the roulette game.

2. The method of claim 1 wherein the means for uniquely identifying the multiple sections comprises color-coding the sections.

3. The method of claim 1 further comprising segmenting the roulette wheel into six sections comprising six numbers each.

4. The method of claim 3 further comprising paying 5 to 1 on winning wagers on said sections.

5. The method of claim 1 further comprising color-coding each number wager area on a roulette layout to match the color-coding of the roulette wheel.

6. The method of claim 1 facilitated by an electronic gaming device or global computer network.

7. A method of conducting a roulette game comprising:

segmenting a single roulette wheel into six sections wherein each section is formed of six, unique adjacent numbers, excluding zero and double zero which belong to none of the six sections;

permanently color-coding each of the six sections;

providing on a roulette game layout six wager areas corresponding to the six sections; and conducting the roulette game.

8. The method of claim 7 further comprising paying 5 to 1 on winning wagers on the six sections.

9. The method of claim 7 further comprising color-coding each number wager area on the roulette layout to match the color-coding of the sections.

10. The method of claim 7 facilitated by an electronic gaming device or global computer network.

11. A method of conducting a live wagering game comprising:

segmenting a single roulette wheel into six sections wherein each of the sections is formed of six, unique adjacent numbers, excluding zero and double zero which belong to none of the six sections;

permanently color-coding each of the six sections;

providing on a roulette game layout six wager areas corresponding to the six sections;

color-coding individual number wager areas on the layout to match the color-coded sections on the roulette wheel; and conducting the roulette game.

12. The method of claim 11 further comprising paying 5 to 1 on winning wagers on the six sections.

13. The method of claim 11 facilitated by an electronic gaming device or global computer network.

* * * * *